US008653452B2

(12) United States Patent
Albeanu et al.

(10) Patent No.: US 8,653,452 B2
(45) Date of Patent: Feb. 18, 2014

(54) TRIPLE SWITCH TOPOLOGY FOR DELIVERY ULTRAFAST PULSER POLARITY SWITCHING FOR MASS SPECTROMETRY

(75) Inventors: Nicolae Albeanu, Richmond Hill (CA); Martian Dima, Richmond Hill (CA)

(73) Assignee: DH Technologies Developmenty Pte. Ltd., Singapore (SG)

( * ) Notice: Subject to any disclaimer, the term of this patent is extended or adjusted under 35 U.S.C. 154(b) by 0 days.

(21) Appl. No.: 13/695,535

(22) PCT Filed: May 6, 2011

(86) PCT No.: PCT/IB2011/000972

§ 371 (c)(1), (2), (4) Date: May 6, 2013

(87) PCT Pub. No.: WO2011/138669

PCT Pub. Date: Nov. 10, 2011

(65) Prior Publication Data

US 2013/0214148 A1 Aug. 22, 2013

Related U.S. Application Data

(60) Provisional application No. 61/332,387, filed on May 7, 2010.

(51) Int. Cl.
*H01J 49/16* (2006.01)

(52) U.S. Cl.
CPC ..... *H01J 49/16* (2013.01)
USPC ..... 250/287

(58) Field of Classification Search
USPC ..... 250/287, 281, 282
See application file for complete search history.

(56) References Cited

U.S. PATENT DOCUMENTS 6,204,500 B1 * 3/2001 Whitehouse et al. ..... 250/287
2005/0001163 A1 * 1/2005 Belov et al. ..... 250/290

* cited by examiner

*Primary Examiner* — Kiet T Nguyen

(57) ABSTRACT

There is provided a pulser, a time of flight mass spectrometer system comprising the same, and a method of analyzing the ions using the pulser. The pulser comprises a first positive switch for coupling and decoupling a first electrode of the accelerator assembly to a first positive voltage; a first negative switch for coupling and decoupling the first electrode to a first negative voltage; and, a first bipolar switch for alternately coupling and decoupling the first electrode to a third voltage.

20 Claims, 6 Drawing Sheets

TRIPLE SWITCH TOPOLOGY FOR DELIVERY ULTRAFAST PULSER POLARITY SWITCHING FOR MASS SPECTROMETRY

RELATED APPLICATIONS

This application is a National Stage filing under 35 U.S.C. §371 PCT/IB11/00972, which claims priority to U.S. Provisional Application Ser. No. 61/332,387 filed on May 7, 2010, entitled "Triple Switch Topology for delivering Ultrafast Pulser Polarity Switching for Mass Spectrometry," which are incorporated by reference in their entireties.

FIELD

The present invention relates generally to systems and methods for operating a time of flight mass spectrometry detection system.

INTRODUCTION

Time of flight mass spectrometry (TOFMS) involves accelerating ions through a field-free drift chamber toward a detector by application of a short, high-intensity electric field of known strength. Pulsers are generally used to supply the electric field. The electric field is applied to impart kinetic energy to all ions, such that the ion's particle velocity across the drift chamber depends on its m/z ratio. Ions with larger m/z ratios will tend to move at lower velocities, and ions with smaller m/z ratios will tend to move at higher velocities. Each ion's flight time across the field-free drift chamber to reach the detector, which is located a known distance from the ion source, is measurable. The m/z ratios of the ions can then be determined using flight time information and known experimental parameters. Ion flux intensities can also be estimated.

SUMMARY

The following summary is intended to introduce the reader to this specification but not to define any invention. One or more inventions may reside in a combination or sub-combination of the apparatus elements or method steps described below or in other parts of this document. The inventors do not waive or disclaim their rights to any invention or inventions disclosed in this specification merely by not describing such other invention or inventions in the claims.

The embodiments described herein provide in one aspect, a pulser for use with an accelerator assembly of a time of flight mass spectrometer system, the pulser comprising:

a first positive switch for coupling and decoupling a first electrode of the accelerator assembly to a positive voltage;

a first negative switch for coupling and decoupling the first electrode to a negative voltage; and a first bipolar switch for alternately coupling and decoupling the first electrode to a third voltage.

The embodiments described herein provide in another aspect, a time of flight mass spectrometer system comprising:

an ion source;

a time of flight mass analyzer coupled to the ion source, the time of flight mass analyzer comprising:

an accelerator assembly for accelerating ions received from the ion source, the accelerator assembly comprising: a first electrode; and a pulser, the pulser comprising: a first positive switch for coupling and decoupling the first electrode to a positive voltage; a first negative switch for coupling and decoupling the first electrode to a negative voltage; a first bipolar switch for alternately coupling and decoupling the first electrode to a third voltage; and a detector, for detecting the ions.

The embodiments described herein provide in another aspect, a method of analyzing ions, the method comprising:

(a) introducing a first set of ions into an accumulation region of an accelerator assembly, the accelerator assembly comprising at least one electrode;

(b) providing a first voltage to the electrode to accelerate ions of a first polarity towards a detector;

(c) introducing a second set of ions into an accumulation region of an accelerator assembly; and (d) providing a second voltage to the electrode to accelerate ions of a second polarity towards the detector.

Further aspects and advantages of the embodiments described herein will appear from the following description taken together with the accompanying drawings.

DRAWINGS

For a better understanding of the embodiments described herein and to show more clearly how they may be carried into effect, reference will now be made, by way of example only, to the accompanying drawings which show at least one example embodiment, and in which.

DESCRIPTION OF VARIOUS EMBODIMENTS

Figure 1:
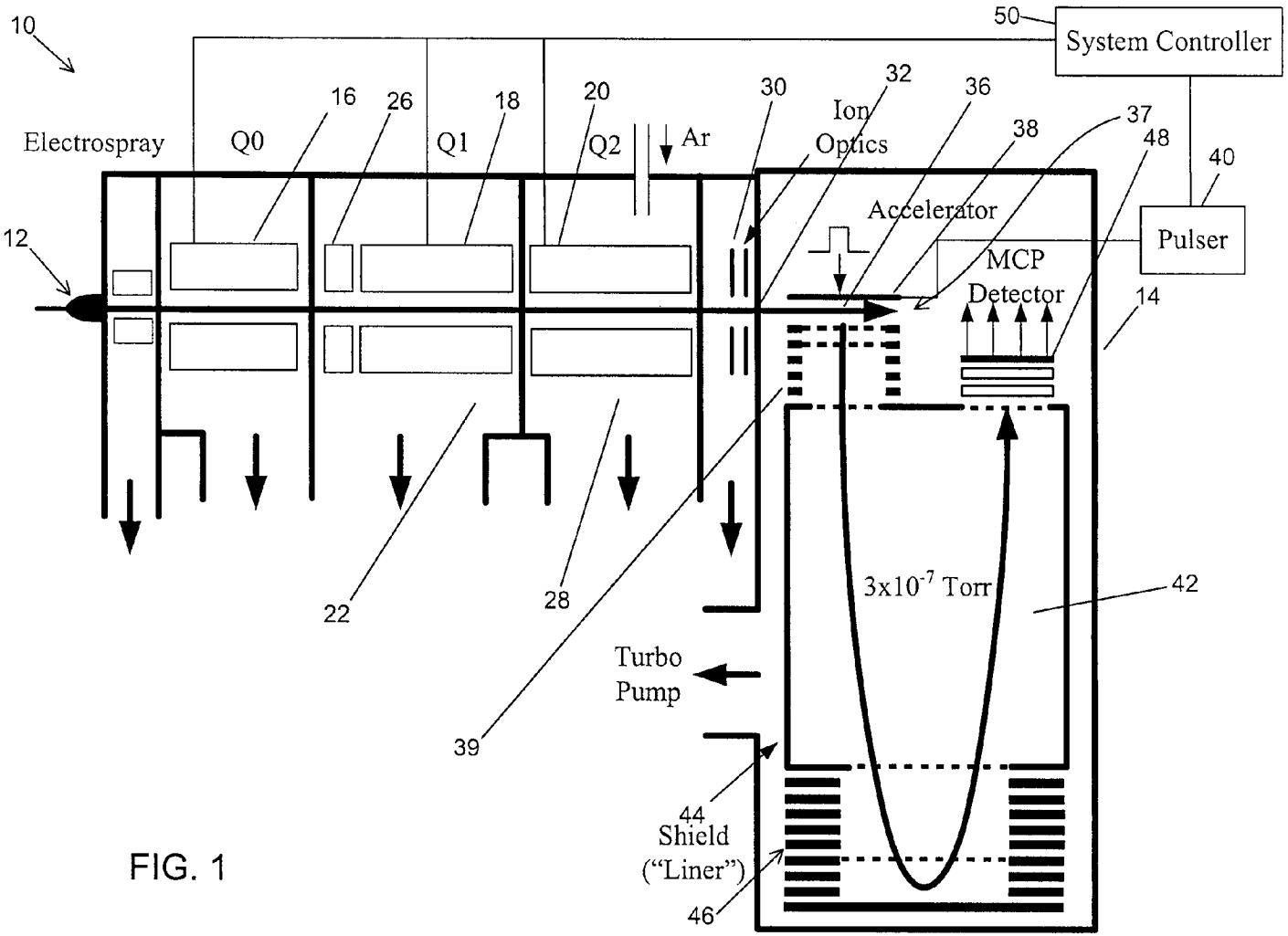
FIG. 1 is a schematic diagram of a mass spectrometer according to aspects of embodiments.

Reference is first made to FIG. 1, which schematically illustrates a mass spectrometer 10 according to aspects of embodiments of the present invention. It should be understood that mass spectrometer 10 represents only one possible MS configuration that may be utilized in embodiments of the present invention. As shown in FIG. 1, mass spectrometer 10 is a hybrid quadrupole/time-of-flight mass spectrometer (QqTOF). However, standalone time-of-flight mass spectrometers (TOF), tandem time-of-flight mass spectrometers (TOF-TOF), and hybrid trap/time-of-flight mass spectrometers (Trap-TOF) can all be utilized in alternative embodiments of the present invention. Still other suitably configured TOF topologies can be used as well.

Mass spectrometer 10 comprises ion source 12, TOF mass analyzer 14 and one or more quadrupoles 16, 18, 20 located upstream of TOF mass analyzer 14. Ion source 12 can be an electrospray source, but it should be understood that ion source 12 can be any other suitable ion source as well, such as an inductively coupled plasma (ICP) ion source, matrix-assisted laser desorption/ionization (MALDI) ion source, glow discharge ion source, electron impact ion source, photo-ionization ion source and the like. Ions emitted from ion source 12 can pass first into collimating quadrupole 16 operated in RF-only mode for providing collisional cooling and focusing. Quadrupole 18 housed in vacuum chamber 22 can be operated in mass resolving mode to selectively transmit ions having m/z ratios falling within a narrow passband or to transmit ions across a broad range of masses in wide band mode. Stubby rods 26 may also be included in the mass spectrometer 10 to facilitate efficient transfer of ions from collimating quadrupole 16 into mass resolving quadrupole 18. Quadrupole 20 can be used as collision cell to fragment incoming ions. Of course, other modes of operation for the quadrupoles 16,18,20 may be apparent to suit the particular MS application.

The pressurized compartment 28 can be operated as a collision cell by supplying a suitable collision gas. Ions accelerated into the pressurized compartment 28 from the quadrupole 18 can then be subjected to collision-induced dissociation (CID) therein. Application of suitable RF/DC voltages to the quadrupole 20 can also provide optional mass filtering in the pressurized cell 28. Analyte ions, which could include both product or precursor ions, can be transmitted into the TOF mass analyzer 14 through ion optical elements 30 and ion inlet 32. Once through ion inlet 32, ions may be collected in a accumulation/acceleration region 36 of accelerator assembly 37. In various embodiments accumulation/acceleration region 36 contains push electrode 38. In some embodiments, accelerator assembly 37 also comprises additional electrodes such as for example, but not limited to, guard rings 39. In various embodiments, guard rings 39 form an acceleration column for accelerating ions. Pulser 40 can be coupled to electrodes 38 and 39 and supplies voltages to these electrodes.

By application of a short, high voltage electric field to electrode 38 during an acceleration time interval ion accumulation will be stopped and ions will be accelerated into the field-free drift chamber 42. TOF mass analyzer 14 also comprises additional electrodes 39 forming an acceleration column. In various embodiments, drift chamber 42 comprises a shield or liner 44. Optionally, one or more ion reflectors 46 may also be included to increase the effective length of the flight path as shown in FIG. 1. In some embodiments, ion reflector 46 comprises a two-stage ion mirror. After passing through drift chamber 42, the ions can be received by ion detector 48 for detection.

It should be understood also that the ion source 12 may be a pulsed or continuous flow ion source and that, in either case, ions can be accelerated into the drift chamber 42 as separate batches (or extractions) of ions.

It should be further understood that mass spectrometer 10 described herein is but one possible TOF topology that may be used according to aspects of embodiments of the present invention. Other TOF topologies, including but not limited to those listed above, may be utilized as well.

In various embodiments, mass spectrometer 10 can comprise a system controller 50. The system controller 50 can include any suitable software, hardware, and firmware. In some embodiments, an application program can be used to operate and control the system controller 50. In various embodiments, the system controller 50 can control various aspects of the mass spectrometer 10. For example, the system controller 50 can control the pulser 40. Specifically, in some embodiments, the system controller 50 controls the switches of pulser 40. In various embodiments, the system controller 50 controls the pulse rate of the voltage applied to the various electrodes of acceleration assembly 37. In some embodiments, the system controller 50 also controls other components of the mass spectrometer 10, including but not limited to the quadrupoles 16, 18 and 20. In some embodiments, the system controller 50 controls the pulser 40 according to one or more properties of the sample ions or analyte ions selected for analysis. In some embodiments, the system controller 50 controls the pulser 40 according to the mass of the analyte ions that have been selected for mass analysis. In some embodiments, the system controller 50 controls the pulser 40 according to the mass to charge ratio of the analyte ions that have been selected for mass analysis. In various embodiments, an application program determines how pulser 40 can be controlled. In some embodiments, different application programs can be selected based on a variety of factors including but not limited to the type of sample.

Figure 2:
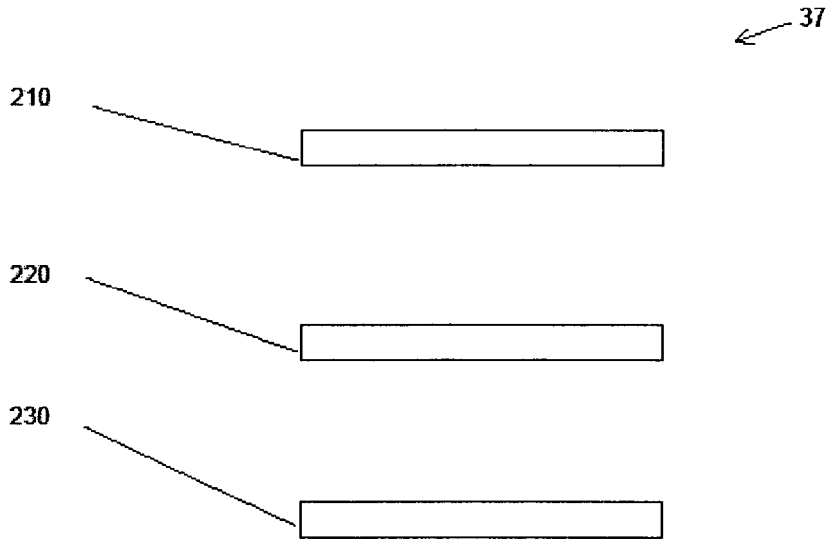
FIG. 2 is a schematic diagram illustrating various components of a pulser according to various embodiments.

Reference is now made to FIG. 2, which is a schematic diagram illustrating various components of acceleration assembly 37 according to various embodiments. In some embodiments, acceleration assembly 37 comprises a plate 210, a grid 220, and ring electrodes 230. However, it should be understood that in other embodiments, acceleration assembly 37 can comprise other numbers of electrodes. For example, in some embodiments, acceleration assembly 37 comprises one electrode. In various other embodiments, acceleration assembly 37 comprises two electrodes. Any suitable number of electrodes may be included.

As explained above, after the ions enter through inlet 32, they can be accelerated by the application of appropriate pulses in the accumulation/acceleration region 36. Specifically, in some embodiments, ions pass into a collection region situated between plate 210 and grid electrodes 220. During this accumulation time interval, ions may fill a region between plate 210 and grid electrodes 220. Once a sufficient amount of ions have accumulated, the ions may be accelerated by applying to plate 210 a voltage pulse having the same polarity as the ions which are to be analyzed. Contemporaneously, a voltage of the opposite polarity as the ions is applied to grid 220. Thus, in the positive mode of operation (where ions of positive polarity are analyzed), a positive voltage pulse can be applied to plate 210 and a negative voltage pulse can be applied to grid 220 contemporaneously. In addition, a voltage of the same polarity as that applied to grid 220 can also be applied to ring 230. The voltages applied to the electrodes produce electric fields, which provide a force to the charged ions and thereby accelerate ions into drift chamber 42 (illustrated in FIG. 1). As will be understood by those skilled in the art, the ions accelerated into the drift chamber are those having the same polarity as the voltage applied to the plate and opposite that of the voltage applied to the grid and the ring. Accordingly, plate 210 and grid 220 "push" and "pull" respectively the ions and thereby accelerate them. In addition, ring 230 serves to further pull the ions to thereby accelerate the ions further. In various embodiments, the pulses applied to the plate 210 and grid 220 control when ions can be accelerated. For example, even when analyzing ions of a single polarity multiple unipolar pulses may be applied to the plate 210 and grid 220 to accelerate multiple groups of ions at different points in time. In various embodiments, the voltage on ring 230 may not be pulsed. In various embodiments, the voltage on ring 230 switches polarity when the ions of a different polarity are to be analyzed. In some embodiments, when ions of the same polarity are analyzed, the voltage applied to the ring remains constant.

In known pulsers, mechanical relays are typically utilized to switch polarities of voltage pulses applied to various electrodes. Such circuits often utilize large capacitors in order to ensure a smooth and stable voltage supplied to all electrodes, such as the ring electrode.

A problem with such circuits may be that mechanical relays are relatively slow in switching and often prone to failures. Accordingly, it can take a relatively long time, for example, a few seconds, in order to switch from a positive mode of operation to a negative mode of operation and vice versa, i.e., to switch the polarity of the pulses in order to be able to investigate ions of the opposite polarity than those currently under investigation.

Another problem may be that the above-mentioned large capacitors must be discharged before the polarity of the voltage applied to the electrodes can be reversed. Given that the capacitors may be relatively large, discharging the capacitors can take a significant amount of time. In addition, once the polarity of the voltage is reversed, it takes time for the capacitor to charge and for the voltage to stabilize. This effectively means that different polarities of ions cannot be analyzed in a relatively short time frame. Accordingly, it is generally not possible to analyze different polarities of ions in the same sample.

Figure 3:
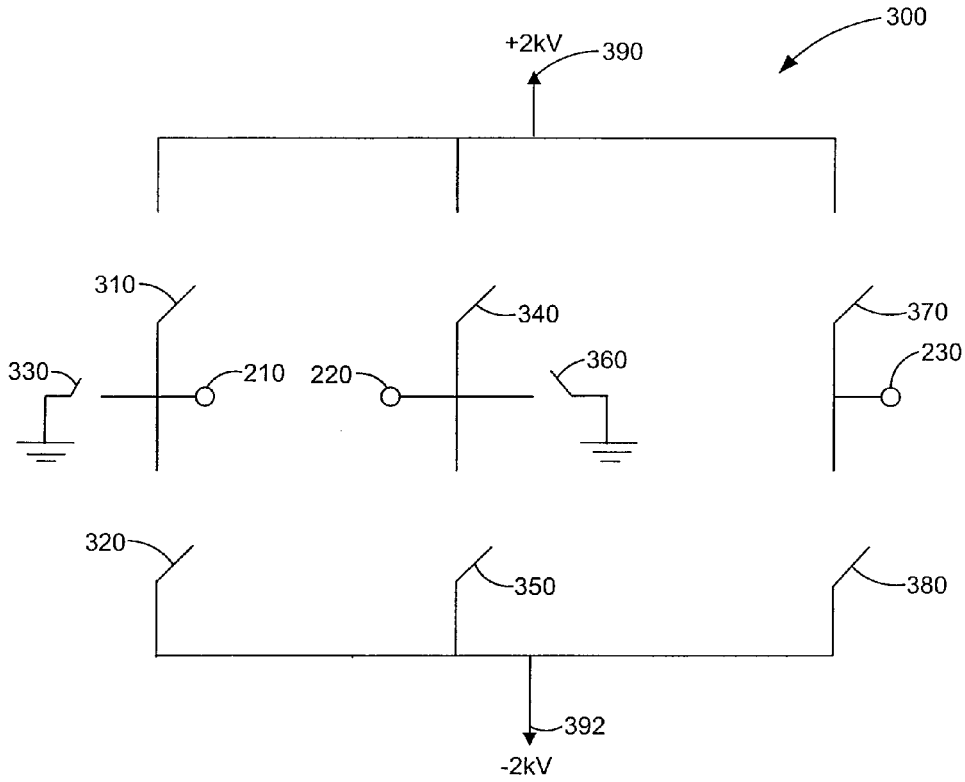
FIG. 3 is a schematic diagram of various embodiments of a circuit utilized by the pulser of FIG. 2.

Reference is next made to FIG. 3, which illustrates, in a schematic diagram, various embodiments of a circuit 300 utilized by pulser 40 and controlled by system controller 50 to supply voltages to various electrodes. Circuit 300 comprises a positive plate switch 310, a negative plate switch 320 and a bipolar plate switch 330. Circuit 300 further comprises a positive grid switch 340, a negative grid switch 350 and a grid bipolar switch 360. Circuit 300 further comprises a positive ring switch 370 and a negative ring switch 380.

Positive plate switch 310 can be coupled between plate 210 and positive voltage source 390. System controller 50 may control switch 310 to alternately couple and decouple plate 210 to positive voltage source 390. Negative plate switch 320 can be coupled between plate 210 and negative voltage source 392. System controller 50 can control switch 320 to alternately couple and decouple the plate 210 to negative voltage source 392. Plate bipolar switch 330 can be coupled between plate 210 and ground. System controller 50 can control switch 330 to alternately couple and decouple plate 210 to ground. Although in some embodiments bipolar switch 330 can be coupled between plate 210 and ground, in other embodiments bipolar switch 330 can be coupled between plate 210 and any appropriate voltage, which can be either a positive or negative voltage.

System controller 50 can control the pulser 40 to be in a positive mode of operation for accumulating and accelerating positive ions, or a negative mode of operation for accumulating and accelerating negative ions.

When the pulser 40 is in the positive mode of operation, the system controller 50 can control: (i) the positive plate switch 310 to periodically couple and decouple the plate 210 to the positive voltage source 390, (ii) the negative plate switch 320 to decouple the plate 210 from the negative voltage source 392, and (iii) the bipolar plate switch 330 to periodically decouple and couple the plate 210 to ground, such that the positive plate switch 310 couples the plate 210 to the positive voltage source 390 when the bipolar plate switch 330 decouples the plate 210 from ground, and the positive plate switch 310 decouples the plate 210 from the positive voltage source 390 when the bipolar plate switch 330 couples the plate 210 to ground.

When the pulser 40 is in the negative mode of operation, the system controller 50 can control (i) the positive plate switch 310 to decouple the plate 210 from the positive voltage source 390, (ii) the negative plate switch 320 to periodically couple and decouple the plate 210 to the negative voltage source 392, and (iii) the bipolar plate switch 330 to periodically decouple and couple the plate 210 to ground, such that the negative plate switch 320 couples the plate 210 to the negative voltage source 392 when the bipolar plate switch 330 decouples the plate 210 from ground, and the negative plate switch 320 decouples the plate 210 from the negative voltage source 392 when the bipolar plate switch 330 couples the plate 210 to ground.

Mass spectrometer 10 can also comprise an ion transmission path between the ion source 12 and plate 210 (provided by quadrupoles 16, 18 and 20, for example), wherein the ion transmission path comprises an optical element (which could, for example, be one or more of the ion optical elements 30), the optical element being coupled to receive an associated voltage; and the system controller 50 can, when the pulser 40 switches between the positive mode of operation and the negative mode of operation, switch a polarity of the associated voltage such that the polarity of the associated voltages can be different in the positive mode of operation and the negative mode of operation. For example, in the embodiment of FIG. 1, during the positive mode of operation, a negative DC voltage could be applied to one or more elements of the ion optical elements to block negative ions from entering the accumulation/acceleration region 36, while permitting positive ions to enter the accumulation/acceleration region 36. Then, during the negative mode of operation, the polarity of the voltage applied to these one or more ion optical elements could be switched to be positive, to permit negative ions to enter the accumulation/acceleration region, while blocking positive ions.

Positive grid switch 340 can be coupled between grid 220 and positive voltage source 390. System controller 50 can control switch 340 to alternately couple and decouple grid 220 to positive voltage source 390. Negative grid switch 350 can be coupled between grid 220 and negative voltage source 392. System controller 50 can control switch 350 to alternately couple and decouple the grid to negative voltage source 392. Grid bipolar switch 360 can be coupled between grid 220 and ground. System controller 50 can control switch 360 to alternately couple and decouple grid 220 to and from ground. Although in some embodiments bipolar switch 360 can be coupled between grid 220 and ground, in other embodiments bipolar switch 360 can be coupled between grid 220 and any appropriate voltage, which can be either a positive or negative voltage.

It will further be understood that the ground voltage connected to the plate 210 by bipolar plate switch 330 may be different from the ground voltage connected to grid 220 by bipolar grid switch 360 even though both may be close to ground. In some embodiments, however, they both may be connected to the same ground value.

When the pulser 40 is in the positive mode of operation (i.e., where ions of a positive polarity are analyzed), the system controller 50 can control (i) the positive grid switch 340 to decouple the grid 220 from the positive voltage source 390, (ii) the negative grid switch 350 to periodically couple and decouple the grid 220 to the negative voltage source 392, (iii) the bipolar grid switch 360 to periodically decouple and couple the grid 220 to ground, In the same mode of operation, system controller 50 can further control the pulser 40 to provide alternating accumulation time intervals (for accumulating ions) and acceleration time intervals (for accelerating ions). To switch to the accumulation time interval, system controller 50 can control the positive plate switch 310 to decouple the plate 210 from the positive voltage source 390 and the bipolar plate switch 330 to couple the plate 210 to ground. This may occur a brief period in time (hereinafter referred to as a delay period) before system controller 50 controls the negative grid switch 350 to decouple the grid 220 from the negative voltage source 392 and the bipolar grid switch 360 to couple the grid 220 to ground.

When switching to the acceleration time interval in the positive mode of operation, system controller 50 can control the positive plate switch 310 to couple the plate 210 to the positive voltage source 390 and the bipolar plate switch 330 to decouple the plate 210 from ground. This may also occur for a delay period before system controller 50 controls the negative grid switch 350 to couple the grid 220 to the negative voltage source 392 and the bipolar grid switch 350 to decouple the grid 220 from ground.

The delay period can be determined to be an amount of time needed for an ion to traverse the distance between the plate 210 and grid 220 such that, for example when switching to the accumulation time interval, grid 220 may be able to finish "pulling" the ions through the space between plate 210 and grid 220 even after plate 210 has connected to ground. In some embodiments, the delay period can be determined by the mass to charge ratio of the ions being analyzed.

In some embodiments, the delay period may be zero seconds such that, for example, switching from ground to a voltage in the acceleration time interval occurs at substantially the same time as both plate 210 and grid 220 (e.g., the closing of positive plate switch 310 and of negative grid switch 350 occurs at substantially the same time). In further embodiments, the switching may occur simultaneously.

When the pulser 40 is in the negative mode of operation (i.e., where ions of a negative polarity are analyzed), the system controller 50 can control (i) the positive grid switch 340 to periodically couple and decouple the grid 220 to the positive voltage source 390, (ii) the negative grid switch 350 to decouple the grid 220 from the negative voltage source 392, and (iii) the bipolar grid switch 360 to periodically decouple and couple the grid 220 to ground.

In the same mode of operation, system controller 50 can further control the pulser 40 to provide alternating accumulation time intervals (for accumulating ions) and acceleration time intervals (for accelerating ions). To switch to the accumulation time interval, system controller 50 can control the negative plate switch 320 to decouple the plate 210 from the negative voltage source 392 and the bipolar plate switch 330 to couple the plate 210 to the ground. There may also occur a delay period before system controller 50 controls the positive grid switch 340 to decouple the grid 220 from the positive voltage source 390 and the bipolar grid switch 220 to couple the grid 220 to the ground.

To switch to the acceleration time interval in the negative mode of operation, system controller 50 can control the negative plate switch 320 to couple the plate 210 to the negative voltage source 392 and the bipolar plate switch 330 to decouple the plate 210 from ground. There may also occur a delay period before system controller 50 controls the positive grid switch 340 to couple the grid 220 to the positive voltage source 390 and the bipolar grid switch 360 to decouple the grid 220 from the ground.

As noted, the delay period can be determined to be the time needed to traverse the distance between plate 210 and grid 220, or in other embodiments, can be zero. Other considerations may also influence the determination of the delay period, including factors such as ease of implementation and the overall operability of mass spectrometer 10.

In either the positive or negative modes of operation, the system controller 50 can control the duration of the acceleration time interval to be of a sufficient time to accelerate the accumulated ions in the accumulation/acceleration region 36. In some embodiments, the duration of the acceleration time interval can differ depending on whether the pulser 40 is in the positive or negative mode of operation. In other embodiments, the duration of the acceleration time interval can be the same in both modes of operation. In one embodiment, system controller 50 can control the length of time of the acceleration time interval to be in the range of 1 microsecond to 100 microseconds.

System controller 50 can control the duration of the accumulation time interval to be the interval of time between successive acceleration time intervals. In some embodiments, the duration of time for the accumulation time interval can be the same for both positive and negative modes of operation of pulser 40. In other embodiments, the duration of the accumulation time interval can be different for positive and negative modes of operation depending on, for example, the duration of time required to accumulate a sufficient number of ions of the desired polarity.

System controller 50 can control the duration of the accumulation time interval to correspond to a clock or repetition rate of a processor (discussed below) associated with pulser 40. In one embodiment, a faster clock speed can allow for a shorter accumulation interval. For example, in an embodiment where the acceleration time interval can be configured to be 10 microseconds, a processor with a clock rate of 10 kilohertz can allow the accumulation time interval to be 90 microseconds, whereas a processor with a clock rate of 1 kilohertz can allow the accumulation time interval to be 990 microseconds. As an alternate example, in an embodiment where the acceleration time interval can be configured to be 5 microseconds, a clock rate of 33 kilohertz can allow the accumulation time interval to be 25 microseconds. In a nutshell, the sum of the accumulation and acceleration time intervals can be the inverse of the clock rate.

Positive ring switch 370 can be coupled between ring 230 and positive voltage source 390. Switch 370 can be used to alternately couple and decouple ring 230 to and from positive voltage source 390. Negative ring switch 380 can be coupled between ring 230 and negative voltage source 392. Switch 380 can be used to alternately couple and decouple the ring to and from negative voltage source 392.

When the pulser 40 is in the positive mode of operation, system controller 50 can control (i) the positive ring switch 370 to decouple the ring 230 from the positive voltage source 390, and (ii) the negative ring switch 380 to couple the ring 230 to the negative voltage source 392.

When the pulser 40 is in the negative mode of operation, system controller 50 can control (i) the positive ring switch 370 to couple the ring 230 to the positive voltage source 390, and (ii) the negative ring switch 380 to decouple the ring 230 from the negative voltage source 392.

As shown in FIG. 3, in various embodiments, only two switches may be coupled to ring 230. As explained above, in some embodiments, unipolar pulses can be applied to plate 210 and grid 220 but not ring 230. In such embodiments, a bipolar switch may not be necessary for ring 230. Specifically, the steady state voltage of ring 230 need only either be at the positive supply voltage or the negative supply voltage.

As explained above, in some embodiments, circuit 300 supplies voltage to three electrodes. However, as mentioned above, a different number of electrodes can be used in various embodiments. For example, in some embodiments, a single electrode can be used. In some such embodiments, the analogous circuit comprises three switches, such as for example switches 310, 320, and 330. Those skilled in the art will understand how circuit 300 can be adapted to other embodiments where a different number of electrodes can be utilized.

In addition, it should be understood that although plate 210, grid 220, and ring electrodes 230 are illustrated as switching between the same positive and negative voltages, in various embodiments, these electrodes can each switch between different voltages values. In other words, the voltage values need not be common to all three electrodes. In addition, although the magnitude of the positive and negative voltages is shown as equal 2 kV, any appropriate voltage values may be used. In various embodiments, the magnitude of voltage can be in the range of +/−0.5 kV to +/−50 kV. In addition, in some embodiments, the magnitude of the positive and negative voltages are different.

In various embodiments, each of the switches 310, 320, 330, 340, 350, 360, 370 and 380 comprise any appropriate switching devices, including, but not limited to, metal oxide field effect transistors (MOSFETs), insulated gate bipolar transistors (IGBT's) or silicon carbide (SiC) VJFET's high voltage devices. In various embodiments, these switching devices are switching devices that are commonly available on the market. In some embodiments, each switch comprises a plurality of MOSFETs connected in series. As will be understood by those skilled in the art, the use of a plurality of MOSFETs can allow for the use of MOSFETs that are rated for a voltage of less or higher than the magnitude of positive voltage source.

However, if a switch comprises multiple MOSFETs that are not rated for the full voltage, then if the MOSFETs are not all turned on and off at the same time, it may be the case that one or more of the MOSFETs in that switch will experience a voltage that is in excess of its rating and the MOSFET may therefore fail. Accordingly, in various embodiments, each switch comprises a plurality of transformers coupled between the control signal source and the gates of the MOSFETs. As will be explained in greater detail below, the use of transformers in accordance with embodiments herein disclosed allow for all the MOSFETs that make up a given switch to be turned on at the same time.

In some embodiments, filtering capacitors are included between each high voltage supply rail and ground. For example, in some embodiments, one or more filtering capacitors can be included between the +2 kV voltage rail and ground and one or more filtering capacitors can be included between −2 kV supply voltage rail and ground. However, given the circuit topology, it may not be necessary to discharge the capacitors before switching the polarity of the voltage applied to the electrodes.

Figure 4:
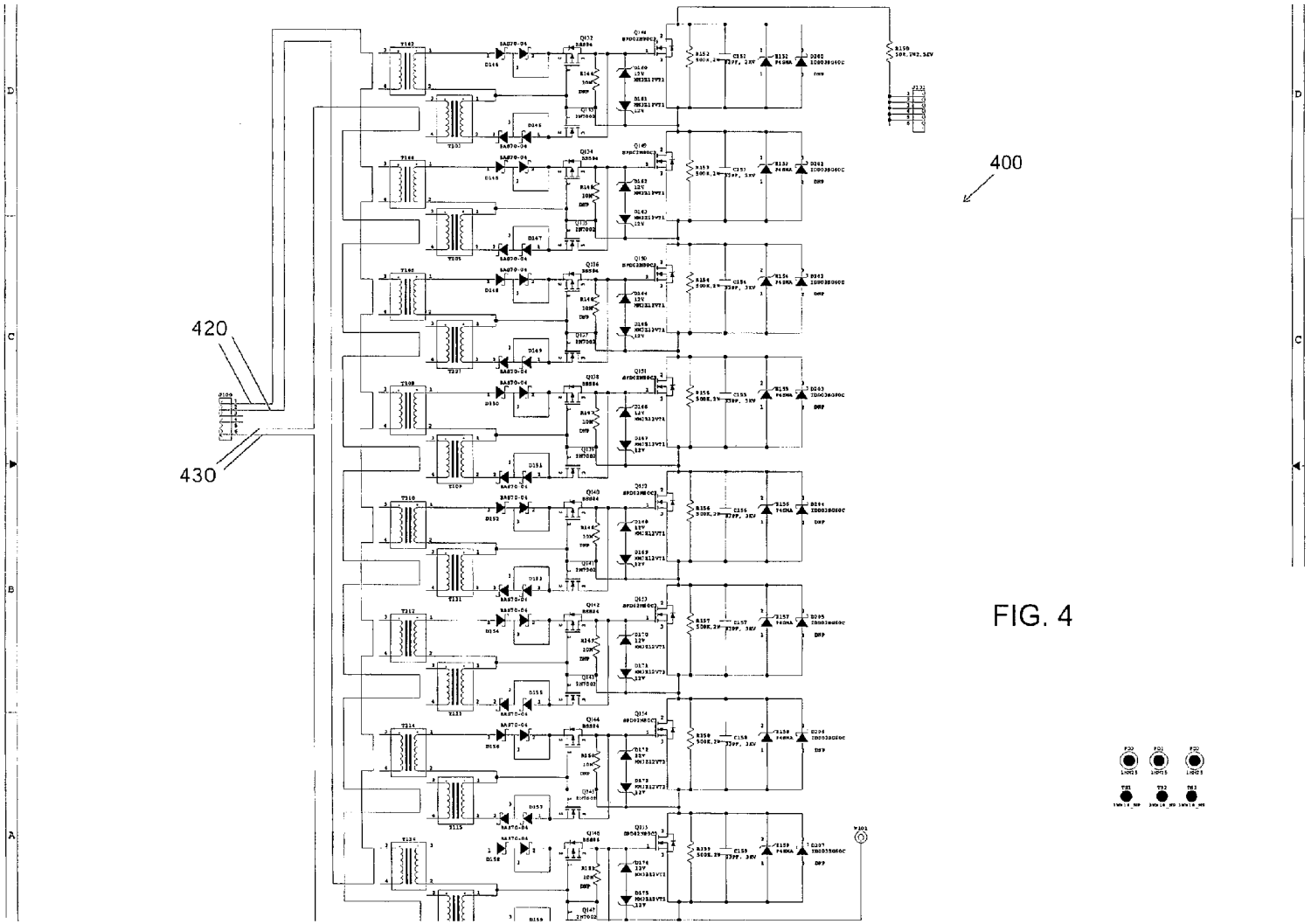
FIG. 4 is schematic diagram of a unipolar switch according to various embodiments.

Reference is next made to FIG. 4, which is a schematic diagram of a unipolar switch 400, according to various embodiments. Switch 400 may be used for example as switches 310, 320, 340, 350, and 370, 380 of FIG. 3. As will be apparent to those skilled in the art from viewing FIG. 4, an analog switch may be constructed for switches 310, 350, and 370.

As can be seen from FIG. 4, switch 400 comprises 8 MOSFETs (Q148 to Q155) connected in series. It should be understood that this is an example only. Any appropriate number of transistors could be used. Some considerations in selecting the number of transistors include the overall voltage that the switch will have across its terminals and the voltage rating of the individual transistors. In general, it is possible to use a smaller number of transistors if each transistor has a higher rated voltage tolerance. However, the cost of transistors generally increases with their voltage rating.

Switch 400 also comprises two set's of 8 pulse transformers, 16 transformers in total (T102 to T117). Each transformer of the first set of transformers can be used to transmit the on signal, which turns the MOSFET on. Similarly, the other transformer set can be used to transmit the off signal, which turns the MOSFET off. In general, in various embodiments, there can be as many transformer pairs as there are transistors that make up the overall switch.

As can be seen from FIG. 4, the inputs of half of the transformers, one for each pair, can be coupled together. Similarly, the inputs of the other half of the transformers, for each pair, can be coupled together. More specifically, the signal line 420 can pass through the inputs of each of transformers T102, T104, T106, T108, T110, T112, T114, and T116. Similarly, Signal line 430 can pass through the inputs if each of transformers T103, T105, T107, T109, T111, T113, T115, and T117.

As a signal pulse is applied to either signal lines 420 and 430, the pulse can be applied simultaneously to the inputs of each of the transformers connected to that signal line. This allows the MOSFET's to be turned on or off at the same time. The use of transformers allows the signal source to be decoupled from the gate of the MOSFET's. If the signal line were directly applied to a series of MOSFET's, the resulting circuit would generally have both a resistance value and capacitance value (where the capacitance is generally the capacitance of the gates of the transistors and the resistance is the sum of the voltage divider resistors used), which would result in a plurality of RC circuits. This would considerably increase the RC time of switching. Also, such circuits, depending on their structure, can introduce delays in the on and off signal reaching each MOSFET gate and therefore could cause the MOSFETs, which make up a particular switch, to turn on and off at different times. As mentioned above, this could result in catastrophic failure of the overall switch. The decoupling provided by the transformers can impede the formation of the undesired RC circuits.

However, it should be understood that not all embodiments utilize transformers. Some other embodiments utilize other circuits for activating the gates like ultrafast opto-couplers with matched ultra low propagation delay times. In various embodiments, any appropriate circuit element can be used for electrically isolating or electrically decoupling the signal source from the gate of the MOSFET. It is not intended to exclude the use of other circuits, including ones that utilize resistor networks.

Figure 5:
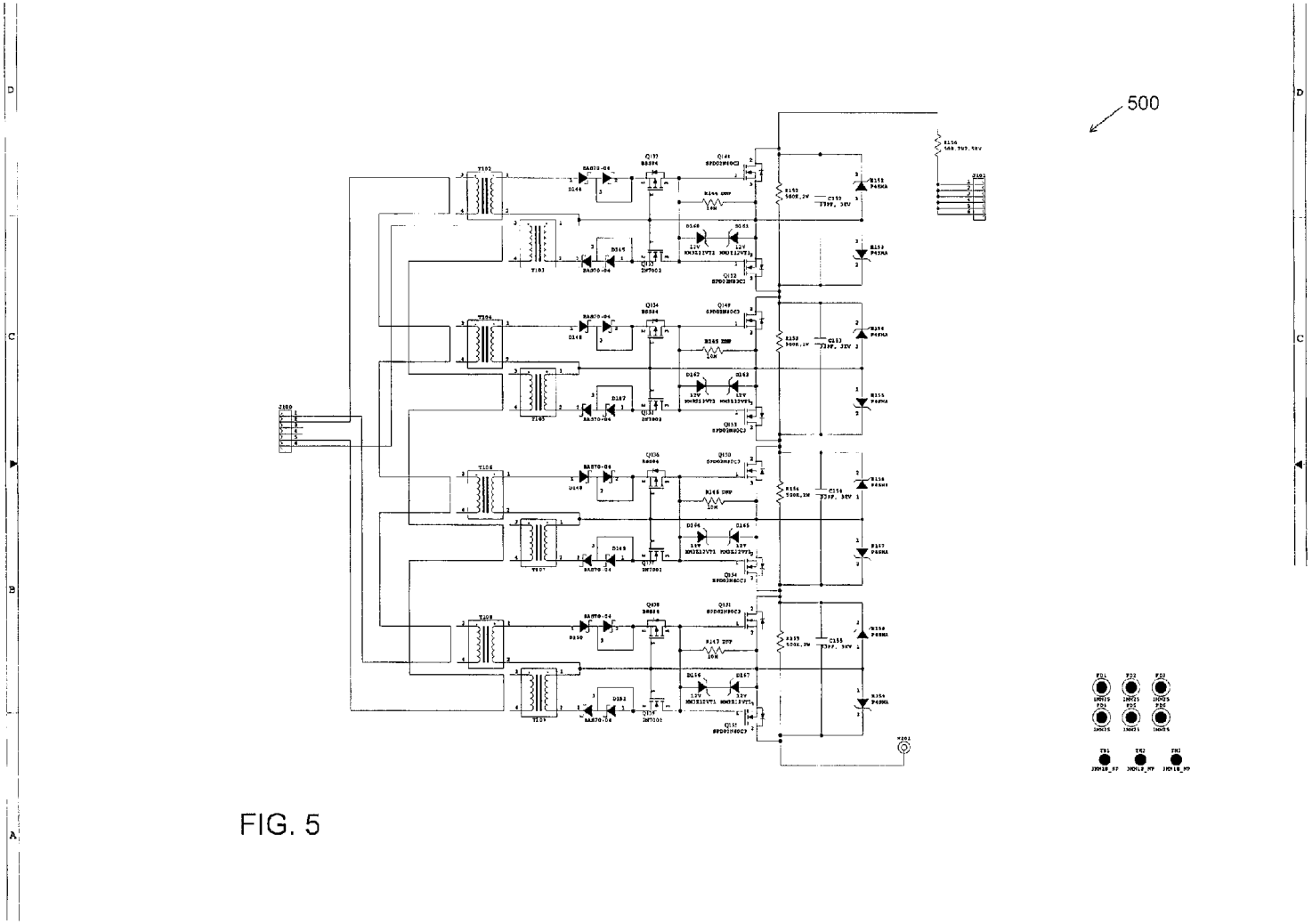
FIG. 5 is schematic diagram of a bipolar switch according to various embodiments.

Reference is next made to FIG. 5, which is schematic diagram of a bipolar switch 500, according to various embodiments. Switch 500 may be used for example as switches 330 and 360 of FIG. 3.

Switch 500 can utilize an analogous set of transformers as switch 400 for turning on and off its transistors. Accordingly, these transformers will not be further described here. The description of FIG. 4 may be referred to for greater detail.

Unlike switch 400, switch 500 can be a bipolar switch and can effectively conduct current in both directions. In various embodiments, this is done by using transistors connected in a back to back configuration. Specifically, pairs of transistors are used with each pair having their gates connected in parallel and their terminals connected in series in a back to back fashion. In the back to back configuration, each pair of transistors can be connected in series where the common terminal can be either the drain or the source.

It should be understood that when other semiconductor devices are used to construct each switch, it may not be necessary to use a back to back design for the bipolar switch. It should be understood that although some of the switches are described as unipolar switches, bipolar switches could be used in their place.

Figure 6:
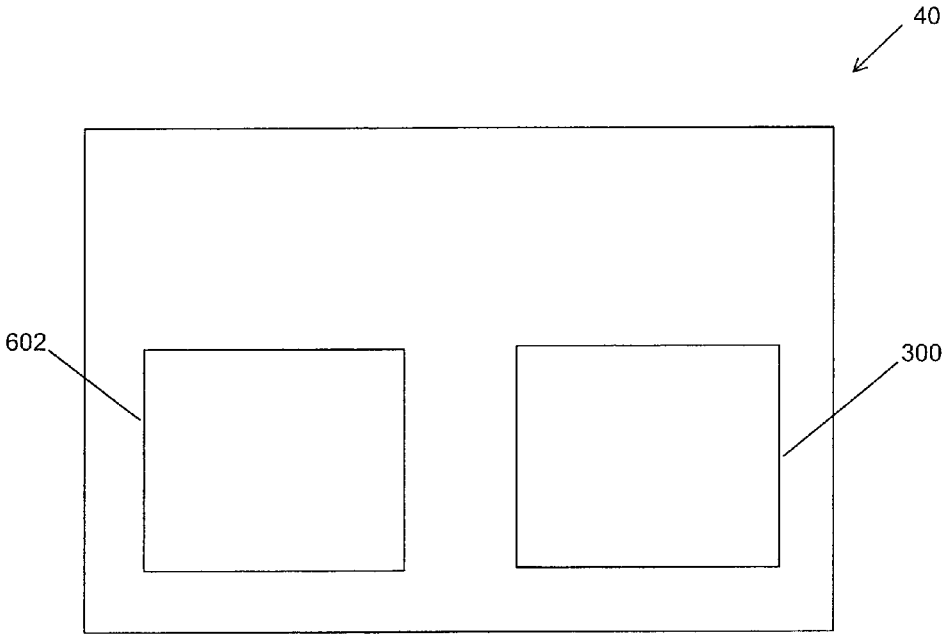
FIG. 6 is a functional block diagram of a pulser according to various embodiments.

Reference is now made to FIG. 6, which illustrates a functional block diagram of pulser 40 according to various embodiments. Pulser 40 comprises a processor 602 programmed to operate the switches of circuit 300. In some embodiments, processor 602 can be a complex programmable logic device (CPLD). Processor 602 can be configured to operate the switches appropriately. For example, it can ensure that switches that should not be turned on at the same time are not turned on at the same time. For example, referring to FIG. 3, any two or more of switches 310, 320 and 330 should not be turned on at the same time. Thus, the processor can ensure that such switches are not turned on at the same time.

In addition, for MOSFETs, there can be a delay in time between when a signal is sent to turn on or off the MOSFETs and when the MOSFETs actually turn on or off. This may be a result of, for example, the fact that the transistor gate must charge or discharge before turning completely on or off and the charging and discharging of the gate is not instantaneous. Thus, in some embodiments that utilize MOSFETs, processor 602 can also be programmed to ensure that sufficient time is left between turning off one transistor (e.g. 310) and turning on another transistor (e.g. 330) to avoid cross conduction off the high voltage switches. If a delay is not utilized, then an inappropriate connection may result (e.g. a short between ground and the positive voltage supply) given that both transistors may be turned on at the same time even though one of the transistors can be given the control signal to turn off and the other can be given a signal to turn on.

Known quadrupole mass spectrometers can switch polarity much more quickly than known pulsers used in TOF mass spectrometers. Accordingly, in a hybrid quadrupole-TOF instruments quadrupoles can supply a first sample of ions to a TOF mass analyzer and then provide a second sample of ions of a second polarity much more quickly than a known pulser can switch polarity in order to process the second group of ions. In general, quadrupoles can switch polarity on the order of microseconds; whereas, it can take known pulsers a second or up to several minutes to switch polarity. Accordingly, with known pulsers and quadrapules, there may be a significant mismatch in the speed at which successive samples of opposite polarity ions can be processed by the quadrapule as compared to the known pulser. In other words, known pulsers are generally rather slow and therefore the TOF mass analyzer may be a "bottleneck" in mass spectrometry systems that need to analyze ions of both polarities concurrently within a single analysis cycle.

This can result in several problems. For example, if the pulser polarity cannot be switched quickly enough, then samples may have to be analyzed in two runs. The first run may operate with ions of one polarity while the second run may operate with ions of opposite polarity. Therefore, it may take at least twice as long to perform mass analysis with known pulsers than it would if the pulser were able to switch more quickly. In addition, slow switching speeds of a pulser can be a problem, for example, when the mass spectrometer containing the pulser is used in liquid chromatography-mass spectrometry. With liquid chromatography mass analysis methods, it can take many minutes to separate an initial sample before it is introduced to a mass spectrometer. In addition, the elution peak may only last several seconds. Accordingly, known pulsers may not be able to switch polarity quickly enough to allow for the analysis of both positive and negative ions that are produced during the elution peak. Specifically, known pulsers may not be able to switch polarity in several seconds to be able to separately (i.e. at different times) accelerate positive and negative ions in the same direction.

In contrast to known pulsers, in various embodiments, pulser 40 can switch polarity on the order of nanoseconds. In some embodiments, pulser 40 can switch polarity on the order of microseconds. In some embodiments, pulser 40 can switch polarity within a time in the range of 1 ns to 1 s. The particular speed with which pulser 40 switches polarity may depend on a variety of factors. For example, the particular components selected for circuit 300 as well as the magnitude of the voltages that are applied to the electrodes of pulser 40 can affect that speed with which pulser 40 can switch polarities. For example, in some embodiments, MOSFETs are used for the switches in pulser 40 and these MOSFETS may have a specific rise time and fall time associated with them, which would limit the speed at which pulser 40 can switch polarity. Other electrical components may also affect the rise and fall time.

In some embodiments, pulser 40 can switch polarity more quickly than that of known quadrupoles. In other embodiments, pulser 40 can switch polarity at a speed that is similar to that of known quadrupoles. Accordingly, in various embodiments, pulser 40 can be used to analyze new samples of ions of different polarities at a rate that substantially matches the rate at which known quadrupoles are able to provide the ions. In some embodiments, pulser 40 can be used to analyze new samples of ions of different polarities at a rate that exceeds the rate at which known quadrupoles are able to provide the ions.

In various embodiments, a sample of ions can be produced at ion source 12. The ions may then pass through quadrupoles 16, 18, 20 and eventually into TOF mass analyzer 14. As described above, ions that enter TOF mass analyzer 14 first fill an accumulation region 36 of accelerator assembly 37. Accelerator assembly 37 and pulser 40 can then accelerate a group of ions into drift chamber 42. The group of ions that can be accelerated is at least a portion of ions that fill accumulation region 36 of accelerator assembly 37. In some embodiments, both positive and negative ions may fill accumulation region 36 of accelerator assembly 37. In some other embodiments, ions of only a single polarity fill accumulation region 36 of accelerator assembly 37. In some embodiments, this can be achieved by operating the quadrupoles such that they transmit only ions of a single polarity at any one time. After being accelerated by accelerator assembly 37 and pulser 40, the ions pass through drift chamber 42 and are detected by detector 48.

In various embodiments, pulser 40 can switch polarity such that ions of opposite polarity can be analyzed within a short time period of each other. In some embodiments, this time period can be less than 1 second. In some embodiments the period can be on the order of microseconds. In some embodiments, accelerator assembly 37 and pulser 40 can accelerate a first group of ions of a first polarity and then accelerate a second group of ions of the opposite polarity within 500 microseconds. In other embodiments, the time it takes for the pulser 40 to switch between a positive mode of operation and a negative mode of operation can be in the range of 1 microsecond to 200 microseconds. In some embodiments, accelerator assembly 37 and pulser 40 can accelerate a first group of ions of a first polarity and then accelerate a second group of ions of the opposite polarity within 100 microseconds. In some embodiments, accelerator assembly 37 and pulser 40 can accelerate a first group of ions of a first polarity and then accelerate a second group of ions of the opposite polarity within 25 microseconds. In some embodiments, accelerator assembly 37 and pulser 40 can accelerate a first group of ions of a first polarity and then accelerate a second group of ions of the opposite polarity within 10 microseconds.

In various embodiments, the polarities of the electrodes of accelerator assembly 37 are not switched until detector 48 has detected the full spectrum of the previous group of ions that were accelerated by pulser 40. In some other embodiments, the full spectrum need not be detected before the polarity is switched.

In some embodiments, quadrupoles 16, 18, 20 are used to first transmit a sample of ions of a first polarity to TOF mass analyzer 14. Shortly thereafter, quadrupoles 16, 18, 20 are used to first transmit a sample of ions of the opposite polarity to TOF mass analyzer 14.

The foregoing aspects of the methods, the pulsers, and the mass spectrometry systems are provided for exemplary purposes only. Those skilled in the art will recognize that various changes may be made thereto without departing from the spirit and scope of the methods, the pulsers, and the mass spectrometry systems as defined by the appended claims.

The invention claimed is:

1. A pulser for use with an accelerator assembly of a time of flight mass spectrometer system, the pulser comprising:

a first positive switch for coupling and decoupling a first electrode of the accelerator assembly to a first positive voltage;

a first negative switch for coupling and decoupling the first electrode to a first negative voltage; and a first bipolar switch for alternately coupling and decoupling the first electrode to a third voltage.

2. The pulser of claim 1, further comprising:

a second positive switch for coupling and decoupling a second electrode of the accelerator assembly to a second positive voltage;

a second negative switch for coupling and decoupling the second electrode to a second negative voltage; and a second bipolar switch for alternately coupling and decoupling the second electrode to a fourth voltage.

3. The pulser of claim 2, wherein the fourth voltage is equal to the third voltage.

4. The pulser of claim 2, further comprising:

a third positive switch for coupling and decoupling a third electrode of the accelerator assembly to a third positive voltage; and a third negative switch for coupling and decoupling the third electrode to a third negative voltage.

5. The pulser of claim 4, wherein the first positive voltage equals the second positive voltage, which equals the third positive voltage, and wherein the first negative voltage equals the second negative voltage, which equals the third negative voltage.

6. The pulser of claim 1, wherein at least one of the switches comprises a plurality of power metal oxide field effect transistors connected in series, and further comprising circuitry for turning each of the transistors on or off concurrently.

7. The pulser of claim 6, wherein each transistor comprises a gate; and wherein the circuitry comprises:

a control signal source for supplying a control signal to the gate of each of the transistors for alternately charging and discharging the gate; and at least one decoupling device for electrically decoupling the control signal source from the transistor gates.

8. The pulser of claim 7, wherein the at least one decoupling device comprises:

a first set of one of transformers and opto-couplers coupled between the control signal source and each gate for transmitting an on signal; and a second set of one of transformers and opto-couplers coupled between the control signal source and each gate for transmitting an off signal.

9. The pulser of claim 1, further comprising control circuitry, wherein the control circuitry is operable to switch the pulser between a positive mode of operation and a negative mode of operation, such that when the pulser is in the positive mode of operation, i) the first positive switch periodically couples and decouples the first electrode to the first positive voltage, ii) the first negative switch decouples the first electrode from the first negative voltage, and iii) the first bipolar switch periodically decouples and couples the first electrode to the third voltage, such that the first positive switch couples the first electrode to the first positive voltage when the first bipolar switch decouples the first electrode from the third voltage, and the first positive switch decouples the first electrode from the first positive voltage when the first bipolar switch couples the first electrode to the third voltage, and when the pulser is in the negative mode of operation, i) the first positive switch decouples the first electrode from the first positive voltage, ii) the first negative switch periodically couples and decouples the first electrode to the first negative voltage, and iii) the first bipolar switch periodically decouples and couples the first electrode to the third voltage, such that the first negative switch couples the first electrode to the first negative voltage when the first bipolar switch decouples the first electrode from the third voltage, and the first negative switch decouples the first electrode from the first negative voltage when the first bipolar switch couples the first electrode to the third voltage.

10. The pulser of claim 9 wherein the control circuitry is operable to switch the pulser between the positive mode of operation and the negative mode of operation in the range of 1microsecond to 200 microseconds.

11. A time of flight mass spectrometer system comprising:

an ion source;

a time of flight mass analyzer coupled to the ion source, the time of flight mass analyzer comprising:

an accelerator assembly for accelerating ions received from the ion source, the accelerator assembly comprising:

a first electrode; and a pulser, the pulser comprising:

a first positive switch for coupling and decoupling the first electrode to a first positive voltage;

a first negative switch for coupling and decoupling the first electrode to a first negative voltage;

a first bipolar switch for alternately coupling and decoupling the first electrode to a third voltage; and a detector, for detecting the ions.

12. The system of claim 11, further comprising a system controller coupled to the pulser, the system controller being operable to control the first positive switch, the first negative switch, and the first bipolar switch to switch the pulser to a positive mode of operation for accumulating and accelerating positive ions and to switch the pulser to a negative mode of operation for accumulating and accelerating negative ions, wherein, when the pulser is in the positive mode of operation, the system controller is operable to control i) the first positive switch to periodically couple and decouple the first electrode to the first positive voltage, ii) the first negative switch to decouple the first electrode from the first negative voltage, and iii) the first bipolar switch to periodically decouple and couple the first electrode to the third voltage, such that the first positive switch couples the first electrode to the first positive voltage when the first bipolar switch decouples the first electrode from the third voltage, and the first positive switch decouples the first electrode from the first positive voltage when the first bipolar switch couples the first electrode to the third voltage; and when the pulser is in the negative mode of operation, the system controller is operable to control i) the first positive switch to decouple the first electrode from the first positive voltage, ii) the first negative switch to periodically couple and decouple the first electrode to the first negative voltage, and iii) the first bipolar switch to periodically decouple and couple the first electrode to the third voltage, such that the first negative switch couples the first electrode to the first negative voltage when the first bipolar switch decouples the first electrode from the third voltage, and the first negative switch decouples the first electrode from the first negative voltage when the first bipolar switch couples the first electrode to the third voltage.

13. The system of claim 12, further comprising an ion transmission path between the ion source and the first electrode, wherein the ion transmission path comprises an optical element, the optical element being coupled to receive an associated voltage; and, the system controller is further operable to, when the pulser switches between the positive mode of operation and the negative mode of operation, switch a polarity of the associated voltage such that the polarity of the associated voltages is different in the positive mode of operation and the negative mode of operation.

14. The system of claim 11, wherein the accelerator assembly further comprises:

a second electrode; and wherein the pulser further comprises:

a second positive switch for coupling and decoupling the second electrode to a second positive voltage;

a second negative switch for coupling and decoupling the second electrode to a second negative voltage; and a second bipolar switch for alternately coupling and decoupling the second electrode to a fourth voltage.

15. The system of claim 14, wherein the accelerator assembly further comprises:

a third electrode; and wherein the pulser further comprises:

a third positive switch for coupling and decoupling the third electrode to a third positive voltage; and a third negative switch for coupling and decoupling the third electrode to a third negative voltage.

16. The system of claim 15, further comprising a system controller coupled to the pulser, the system controller being operable to control the first positive switch, the first negative switch, the first bipolar switch, the second positive switch, the second negative switch, the second bipolar switch, the third positive switch and the third negative switch, to switch the pulser to a positive mode of operation for accelerating positive ions and to switch the pulser to a negative mode of operation for accelerating negative ions, wherein, when the pulser is in the positive mode of operation, the system controller is operable to control i) the first positive switch to periodically couple and decouple the first electrode to the first positive voltage, ii) the first negative switch to decouple the first electrode from the first negative voltage, and iii) the first bipolar switch to periodically decouple and couple the first electrode to the third voltage, iv) the second positive switch to decouple the second electrode from the second positive voltage, v) the second negative switch to periodically couple and decouple the second electrode to the second negative voltage, vi) the second bipolar switch to periodically decouple and couple the second electrode to the fourth voltage, vii) the third positive switch to decouple the third electrode from the third positive voltage, viii) the third negative switch to couple the third electrode to the third negative voltage, such that the positive mode of operation may comprise a plurality of alternating accumulation and acceleration time intervals, wherein when switching to the accumulation time interval, the first positive switch decouples the first electrode from the first positive voltage, the first bipolar switch couples the first electrode to the third voltage, the second negative switch decouples the second electrode from the second negative voltage and the second bipolar switch couples the second electrode to the fourth voltage, and when switching to the acceleration time interval, the first positive switch couples the first electrode to the first positive voltage, the first bipolar switch decouples the first electrode from the third voltage, the second negative switch couples the second electrode to the second negative voltage and the second bipolar switch decouples the second electrode from the fourth voltage, and, when the pulser is in the negative mode of operation, the system controller is operable to control i) the first positive switch to decouple the first electrode from the first positive voltage, ii) the first negative switch to periodically couple and decouple the first electrode to the first negative voltage, iii) the first bipolar switch to periodically decouple and couple the first electrode to the third voltage, iv) the second positive switch to periodically couple and decouple the second electrode to the second positive voltage, v) the second negative switch to decouple the second electrode from the second negative voltage, vi) the second bipolar switch to periodically decouple and couple the second electrode to the fourth voltage, vii) the third positive switch to couple the third electrode to the third positive voltage, viii) the third negative switch to decouple the third electrode from the third negative voltage, such that the negative mode of operation may comprise a plurality of alternating accumulation and acceleration time intervals, wherein when switching to the accumulation time interval, the first negative switch decouples the first electrode from the first negative voltage, the first bipolar switch couples the first electrode to the third voltage, the second positive switch decouples the second electrode from the second positive voltage and the second bipolar switch couples the second electrode to the fourth voltage, and when switching to the acceleration time interval, the first negative switch couples the first electrode to the first negative voltage, the first bipolar switch decouples the first electrode from the third voltage, the second positive switch couples the second electrode to the second positive voltage and the second bipolar switch decouples the second electrode from the fourth voltage.

17. The system of claim 16, wherein when the pulser is in the positive mode of operation, and when switching to the accumulation time interval, the first positive switch decouples the first electrode from the first positive voltage and the first bipolar switch couples the first electrode to the third voltage at substantially the same time as when the second negative switch decouples the second electrode from the second negative voltage and the second bipolar switch couples the second electrode to the fourth voltage, and when switching to the acceleration time interval, the first positive switch couples the first electrode to the first positive voltage and the first bipolar switch decouples the first electrode from the third voltage at substantially the same time as when the second negative switch couples the second electrode to the second negative voltage and the second bipolar switch decouples the second electrode from the fourth voltage, and wherein when the pulser is in the negative mode of operation, and when switching to the accumulation time interval, the first negative switch decouples the first electrode from the first negative voltage and the first bipolar switch couples the first electrode to the third voltage at substantially the same time as when the second positive switch decouples the second electrode from the second positive voltage and the second bipolar switch couples the second electrode to the fourth voltage, and when switching to the acceleration time interval, the first negative switch couples the first electrode to the first negative voltage and the first bipolar switch decouples the first electrode from the third voltage at substantially the same time as when the second positive switch couples the second electrode to the second positive voltage and the second bipolar switch decouples the second electrode from the fourth voltage.

18. A method of analyzing ions, the method comprising:

(a) introducing a first set of ions into an accumulation region of an accelerator assembly, the accelerator assembly comprising at least one electrode;

(b) alternately providing a first voltage to the electrode to accelerate ions of a first polarity towards a detector, and a third voltage to the electrode to facilitate accumulation of additional ions of the first polarity;

(c) introducing a second set of ions into an accumulation region of an accelerator assembly; and (d) alternately providing a second voltage to the electrode to accelerate ions of a second polarity towards the detector, and the third voltage to the electrode to facilitate accumulation of additional ions of the second polarity, wherein steps (b) and (d) occur within a time period of less than 1 second.

19. The method of claim 18, wherein the time period is less than 100 microseconds.

20. The method of claim 18, wherein the first and second polarities are the same polarity.

* * * * *